US007798580B2

(12) United States Patent
Goldberg et al.

(10) Patent No.: US 7,798,580 B2
(45) Date of Patent: Sep. 21, 2010

(54) MOBILE COMPUTER SECURITY CART

(75) Inventors: Mark A. Goldberg, Lido Beach, NY (US); Richard B. Leeds, Cold Spring Harbor, NY (US)

(73) Assignee: Global Equipment Company Inc., Port Washington, NY (US)

( * ) Notice: Subject to any disclaimer, the term of this patent is extended or adjusted under 35 U.S.C. 154(b) by 610 days.

(21) Appl. No.: 11/649,420

(22) Filed: Jan. 4, 2007

(65) Prior Publication Data

US 2008/0164792 A1 Jul. 10, 2008

(51) Int. Cl.
*A47B 87/00* (2006.01)

(52) U.S. Cl. ..... 312/111; 312/108

(58) Field of Classification Search ..... 312/107, 312/108, 111, 223.3, 223, 1, 223.6, 7.2, 198, 312/138.1, 278, 279, 249.8, 249.11–249.13, 312/351.11, 351.12; 108/50.01, 50.02; 280/47.34, 280/37.35

See application file for complete search history.

(56) References Cited

U.S. PATENT DOCUMENTS 188,566 A * 3/1877 Barnes ..... 312/201
274,021 A * 3/1883 Oberle ..... 312/290
621,533 A * 3/1899 May ..... 209/242
795,957 A * 8/1905 Cartland ..... 312/265.1
803,184 A * 10/1905 Minchin ..... 312/107
943,350 A * 12/1909 Holden ..... 312/114
1,006,547 A * 10/1911 Hall ..... 312/200
1,109,086 A * 9/1914 Stuck ..... 312/107.5
1,643,101 A * 9/1927 Thompson ..... 312/301
2,312,325 A * 3/1943 Earle ..... 312/273
3,969,006 A * 7/1976 Brown ..... 312/234.1
4,120,549 A * 10/1978 Bureau ..... 312/249.12
4,215,762 A * 8/1980 Cunningham et al. ..... 181/201
4,491,375 A 1/1985 Ugalde
4,600,249 A 7/1986 Anderson
4,636,781 A 1/1987 Wills et al.
4,656,848 A 4/1987 Rose
4,685,402 A 8/1987 Nelson et al.
4,712,842 A * 12/1987 Price et al. ..... 312/223.3
4,768,844 A 9/1988 Ludwig
4,865,404 A 9/1989 Harper
4,938,548 A 7/1990 Richardson
4,986,589 A 1/1991 McNew
4,993,784 A 2/1991 Dana et al.
RE33,953 E 6/1992 Everts
5,163,606 A 11/1992 Isserstedt
5,199,774 A 4/1993 Hedinger et al.
5,303,994 A 4/1994 Elsholz
5,327,752 A 7/1994 Myers et al.
5,352,030 A 10/1994 Derle et al.

(Continued)

*Primary Examiner*—Janet M Wilkens
(74) *Attorney, Agent, or Firm*—Davidoff Malito & Hutcher LLP

(57) ABSTRACT

A mobile computer security cart that includes a cabinet, a platform and an upright, The cabinet includes at least one shelf. The platform is coupled to the cabinet and has a top surface including an uncovered substantially planar surface. The upright is coupled to the platform and is configured to accommodate at least one display. The cart has an assembled configuration in which the platform rests on the top of the cabinet and the upright is coupled to the platform. The cart has a disassembled configuration wherein the upright is positioned adjacent to the front, rear or sides of the cabinet while the platform is positioned adjacent to the top or bottom of the cabinet.

33 Claims, 6 Drawing Sheets

U.S. PATENT DOCUMENTS 5,364,178 A 11/1994 Hofman et al.
5,378,057 A 1/1995 Bach et al.
5,389,919 A 2/1995 Warren et al.
5,577,817 A * 11/1996 Reynolds ..... 312/107
5,620,133 A 4/1997 Isserstedt
5,779,331 A 7/1998 Fox et al.
5,829,859 A 11/1998 Cram
6,018,968 A 2/2000 Sides
6,082,839 A 7/2000 Chiku
6,538,876 B2 * 3/2003 Muller ..... 361/605
6,546,680 B1 * 4/2003 Watts ..... 52/182
6,565,163 B2 5/2003 Behl et al.
6,688,615 B2 * 2/2004 Chen ..... 280/47.35
6,719,386 B2 4/2004 Hoffman
6,752,477 B2 * 6/2004 Goldberg ..... 312/290
6,823,802 B2 * 11/2004 Butts, Jr. ..... 108/25
D550,994 S * 9/2007 Goldberg ..... D6/509
7,401,796 B1 * 7/2008 Greco ..... 280/47.35
2003/0062810 A1 4/2003 Westwinkel
2003/0163714 A1 8/2003 Nortung
2004/0039920 A1 2/2004 Kim et al.
2004/0055713 A1 3/2004 Kimmet

* cited by examiner

MOBILE COMPUTER SECURITY CART

BACKGROUND OF THE INVENTION

The present invention relates to a mobile computer security cart and components therefor for storing and securing computer equipment as well as making such equipment available for usage.

Conventionally, a computer security cart includes a cabinet part with a compartment having one or more shelves and an upper security part with a compartment for containing a display unit (e.g., a computer monitor or display of appropriate depth, a flat panel display and the like) and/or computer and a drawer configured to contain a keyboard. The security arises from the ability to lock one or more of the various drawers or compartments thereby securing the contents.

The upper security part, aside from its sliding drawer, is conventionally made of a one piece construction so as to have a generally L-shape when viewed from the side. Thus, when trying to accommodate the computer security part into a shipping carton, which is generally rectangular or parallelepiped in shape, there is a considerable void forwards of the upright and above the base of the L-shape. Since the shipping cost reflects packaging volume as well as weight, the presence of such a large void within the shipping carton is wasteful. While customizing the carton to the contour of the L-shape would eliminate the void, shipping companies charge a premium for shipping in cartons that are not one of their standard cartons, if they agree to ship the custom carton at all. Further, there is the additional cost of designing and manufacturing custom containers rather than using the standard containers of the shipping companies.

It would be desirable to provide a computer security cart having a combination of features that maximize its usefulness. It would also be desirable to minimize or eliminate the presence of packaging voids during shipment of the computer security cart or its components while employing generally rectangular cartons.

BRIEF SUMMARY OF THE INVENTION

The invention is directed to a component based computer security cart that includes a cabinet configured to accommodate at least one shelf, a platform having an uncovered substantially planar upper surface and an upright suited to accommodate a display unit. The cabinet, the platform and the upright may be configured so that after assembly, the platform rests on a top of the cabinet, the upright being coupled to the platform. Each of the cabinet, the platform and the upright are then secured in position. The cabinet has a front through which a shelf is accessible and has a rear and sides. The upright is positioned in a disassembled condition adjacent to the front, rear or sides of the cabinet while the platform is positioned adjacent the top or bottom of the cabinet.

BRIEF DESCRIPTION OF THE DRAWINGS

For a better understanding of the present invention, reference is made to the following description and accompanying drawings, while the scope of the invention is set forth in the appended claims.

DETAILED DESCRIPTION OF THE INVENTION

Figure 1:
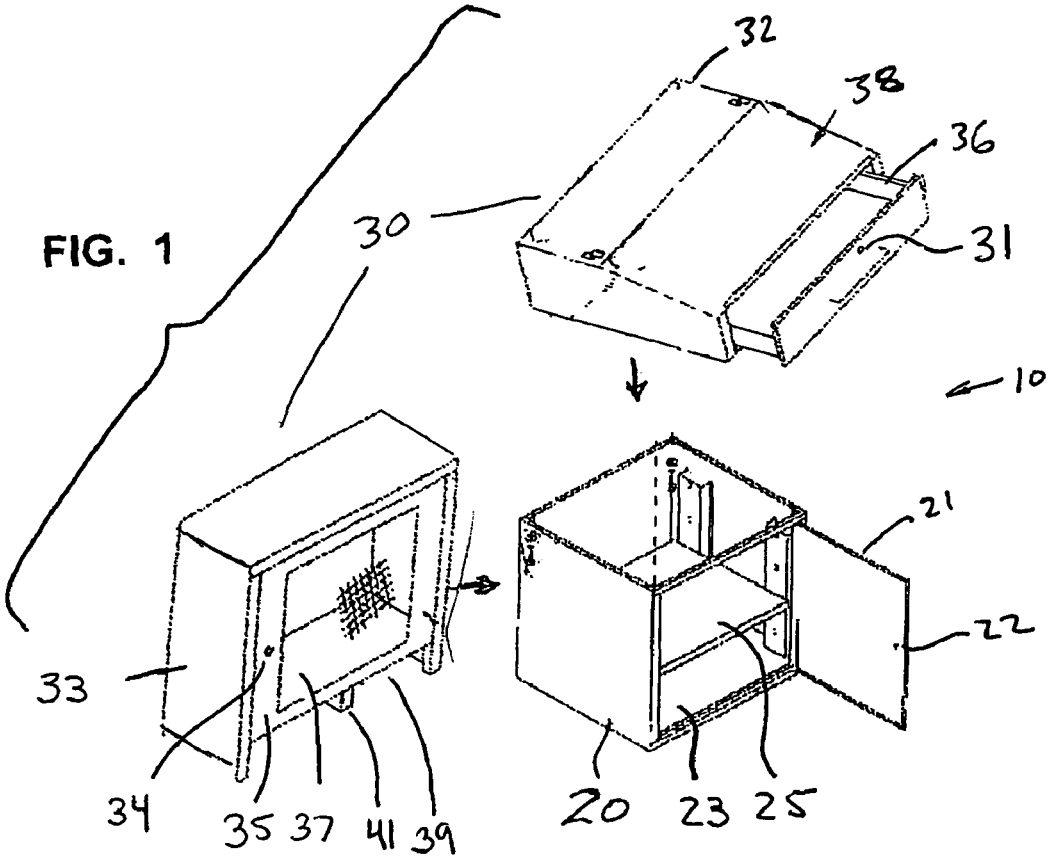
FIG. 1 is an exploded view showing a mobile computer security cart in a disassembled condition suitable for shipping in accordance with the invention.

Turning to the drawings, FIG. 1 shows the mobile computer security cart 10 in a disassembled condition. It includes a cabinet part 20 and an upper security part 30. The cabinet part can optionally include a door 21 and is configured with at least one shelf 23. The door 21 may also be fitted with a lock 22 for securing the door and any contents stored in the cabinet part (e.g., computer components, supplies and the like). It is understood that a variety of locks, as are well known in the art, can be used without departing from the scope of the invention. The cabinet part 20 may also include additional shelves 25 which can be adjustable in height.

The upper security part 30 includes a platform 32 and an upright 33. The upright 33 may have a door 35 which may optionally include a window 37. The door 35 may also be fitted with a lock 34 for securing the door 35 and any contents stored in the upright 33 (e.g., a display unit or the like). It is understood that a variety of locks, as are well known in the art, can be used without departing from the scope of the invention. The window can be made from a variety of materials including but not limited to glass and plastic and can optionally include security features such as laminates and the like. The use of at least a partially transparent window will allow a user to view a display stored in the upright 33 with the door 35 in the closed and/or locked position. The upright 33 may also include a lower opening 39 defining a storage area which may optionally be divided by one or more dividers 41.

The platform 32 may have a drawer 36. The drawer 36 may also be fitted with a lock 31 for securing the drawer and any contents stored in the drawer (e.g., a keyboard, supplies and the like). It is understood that a variety of locks, as is well known in the art, can be used without departing from the scope of the invention. The platform 32 has a top surface that includes an uncovered substantially planar surface 38 (i.e., the surface 38 is not completely covered by the upright). The surface 38 may optionally be inclined with respect to horizontal. In this example, the platform 32 and the upright 33 are detached from each other.

For shipping purposes, the upright 33 may be placed to the rear of the cabinet part 20 as shown. The platform 32 may be placed on top of the cabinet part 20 as shown. Suitable packaging materials, such as cardboard, may be placed between the various parts that are positioned adjacent each other to minimize the risk of scratches or damage due to jostling during shipment.

As can be appreciated, the disassembled mobile computer security cart 10 of FIG. 1 fits into a rectangular or parallelepiped box such that the volume of the components within take up most of the confines of such a box.

Figure 2:
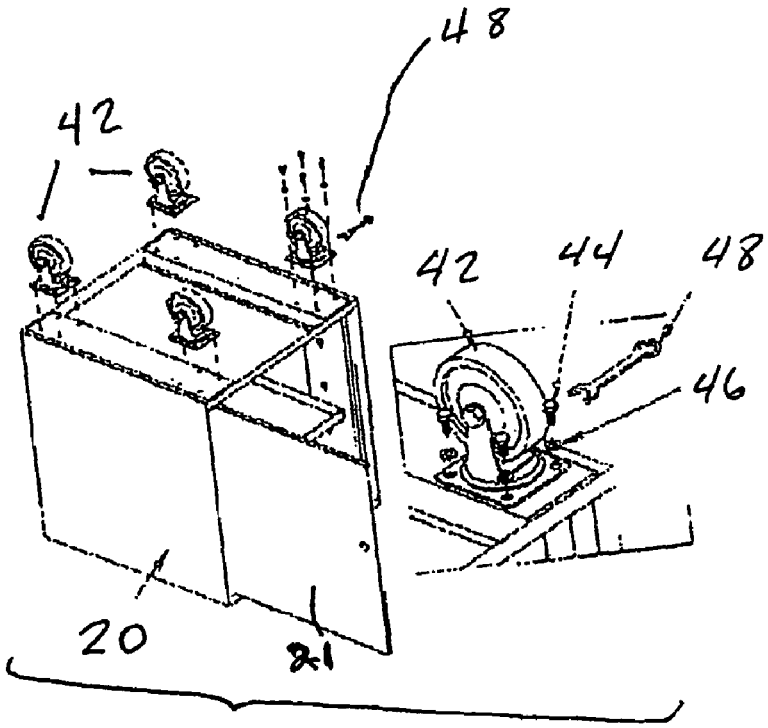
FIG. 2 is an exploded view showing assembly of wheels for a mobile cabinet part of the mobile computer security cart of FIG. 1, together with an enlarged view showing the manner of securing the wheels.
Figure 7:
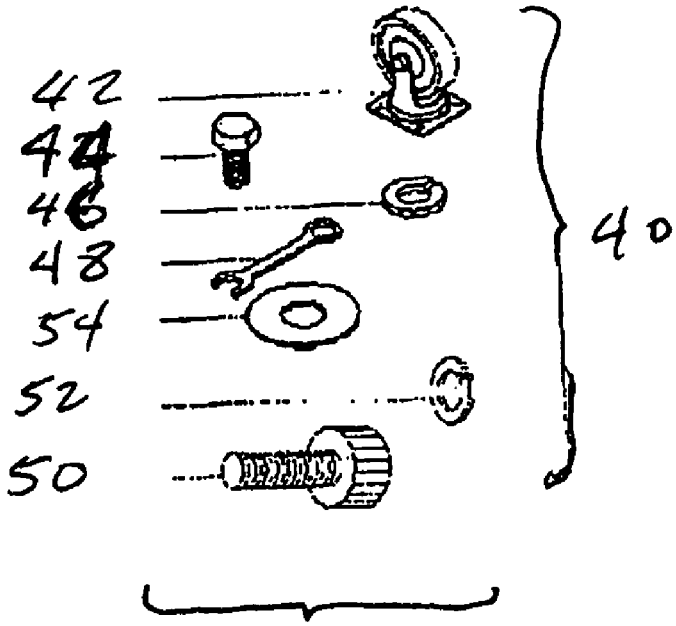
FIG. 7 is a view of exemplary hardware used for effecting assembly in FIGS. 2-5.

After the shipment arrives, the contents are removed to enable assembly of the mobile computer security cart 10 in accordance with FIGS. 2-5 using the hardware 40 of FIG. 7. As shown in FIG. 2, the wheels 42 are secured to the underside of the cabinet part 20 with suitable fasteners 44 and washers 46 by using an appropriate tool 48 such as a hex wrench.

Figure 3:
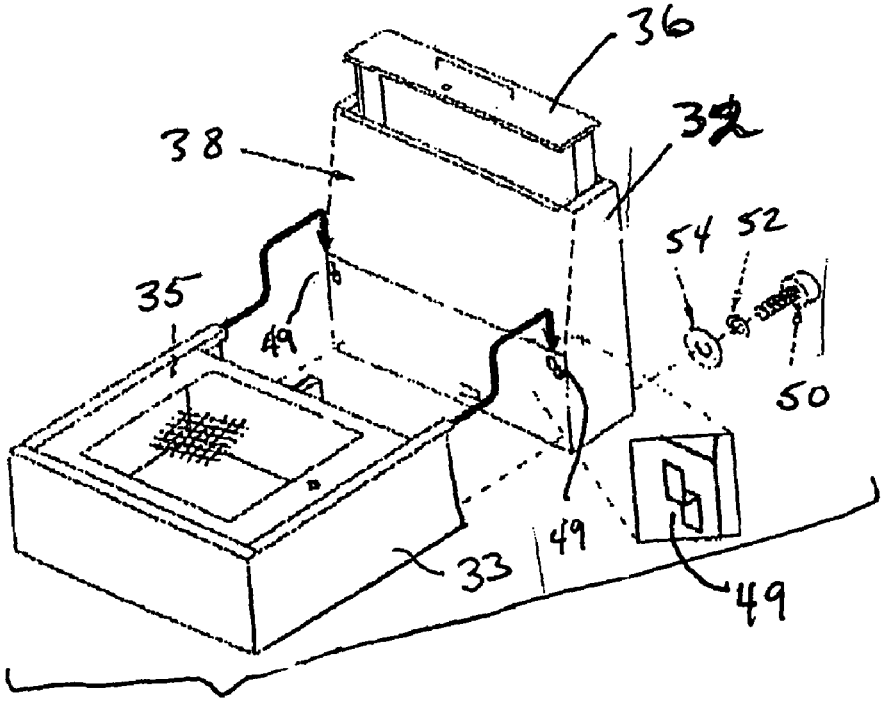
FIG. 3 is an exploded view showing assembly of a computer security part of the mobile computer security cart of FIG. 1, together with an exploded view showing the manner of retaining the computer security part together.

Turning to FIG. 3, the platform 32 and the upright 33 are retained and secured together as shown. To retain the platform 32 with the upright 33, retainers 49 are secured to the topside of the platform 34 on the relatively level surface adjacent to the inclined surface 38. The retainers 49 have free ends inserted into corresponding slots (not shown) in the underside edges of the bottom front of the upright 33 as shown. When so retained to each other, the platform 32 and the upright 33 align holes with each that enable the insertion of appropriate fasteners 50 and washers 52, 54 to secure the platform 32 and the upright 33 to each other towards the rear of each. The retainers 49 are exemplified by a unitary metal plate bent twice so that the portion between the bends extends in a plane substantially perpendicular to the two portions that extend from respective bends outwardly in a parallel manner to each other.

Figure 4:
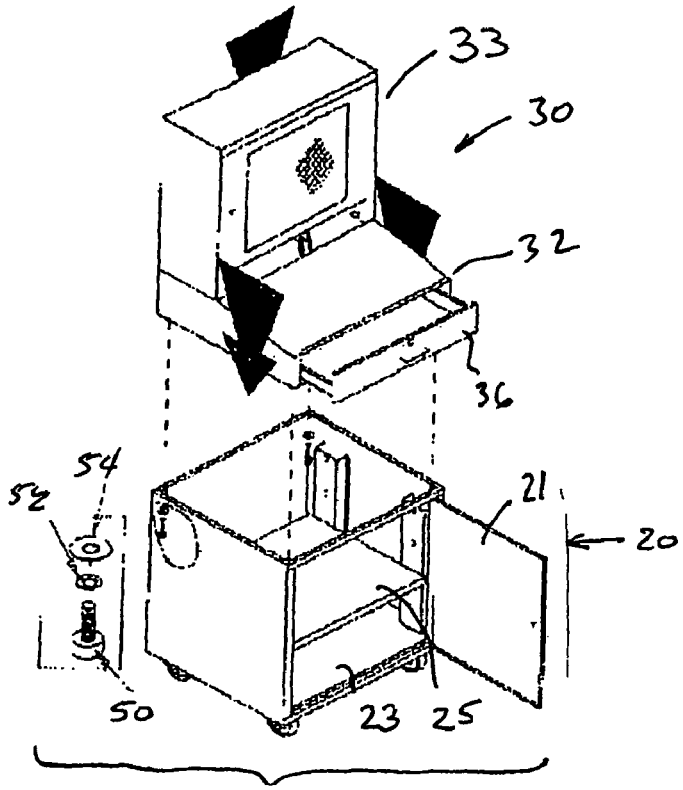
FIG. 4 is an exploded view showing assembly of the computer security part of FIG. 3 onto the mobile cabinet part of FIG. 2 in accordance with the invention, together with an exploded view of the fasteners that secure the computer security part and the cabinet part together.

As shown in FIG. 4, the underside of the assembled computer security part 30 is secured to the topside of the cabinet part 20 with suitable fasteners 50 and washers 52, 54. Note that the fasteners fit into preassembled and properly aligned threaded openings in the various components into which they are to connect. Fasteners 50 and washers 52, 54 shown in FIG. 4 are the same as those shown in FIG. 4.

Further, the cabinet part 20 includes a front, rear, two sides, a bottom and an open top. Within the cabinet, shelving is accessible through the front. The shelving may include a first shelf 23 (lower) and may optionally include additional shelves (e.g., second shelf 25). The lower shelf 23 may also serve as the bottom of the cabinet part 20. It is to the underside of the lower shelf 23 that the wheels 42 are secured as shown in FIG. 2. The cabinet part 20 may have a door 21 that may swing open from a closed position to provide access to the shelving. It is understood that various equipment and/or supplies may be stored in the cabinet. To the extent electrical components such as computers, printers and the like are stored in the cabinet, appropriate cable access to the platform and/or upright may be provided.

Figure 5:
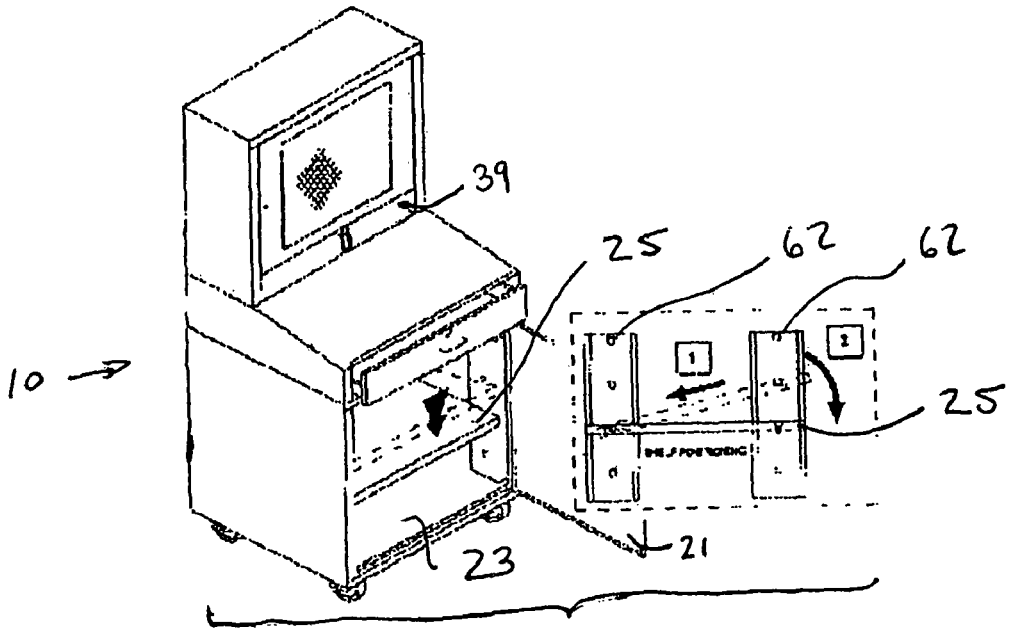
FIG. 5 is a pictorial view of shelf positioning within the mobile cabinet part of FIG. 4, together with an enlarged front view of the shelving positioning for illustrative purposes.
Figure 6:
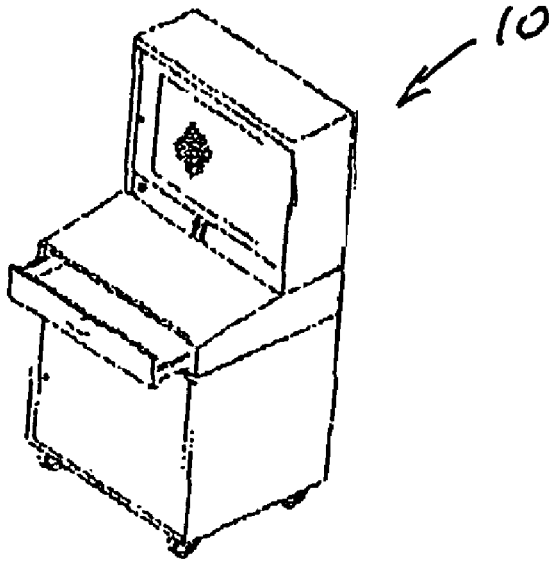
FIG. 6 is a view of the mobile computer security cart of FIGS. 2-5 after assembly is complete.

Turning to FIG. 5, shelf 25 may be adjustable in height or removable and may be inserted or removed by angling the shelf 25 manually as shown. It may be placed in any one of a plurality of elevations by resting the shelf on aligned retainers 62 in a manner known conventionally. The end result is the mobile computer security cart 10 of FIG. 6 in its fully assembled condition.

Figure 8:
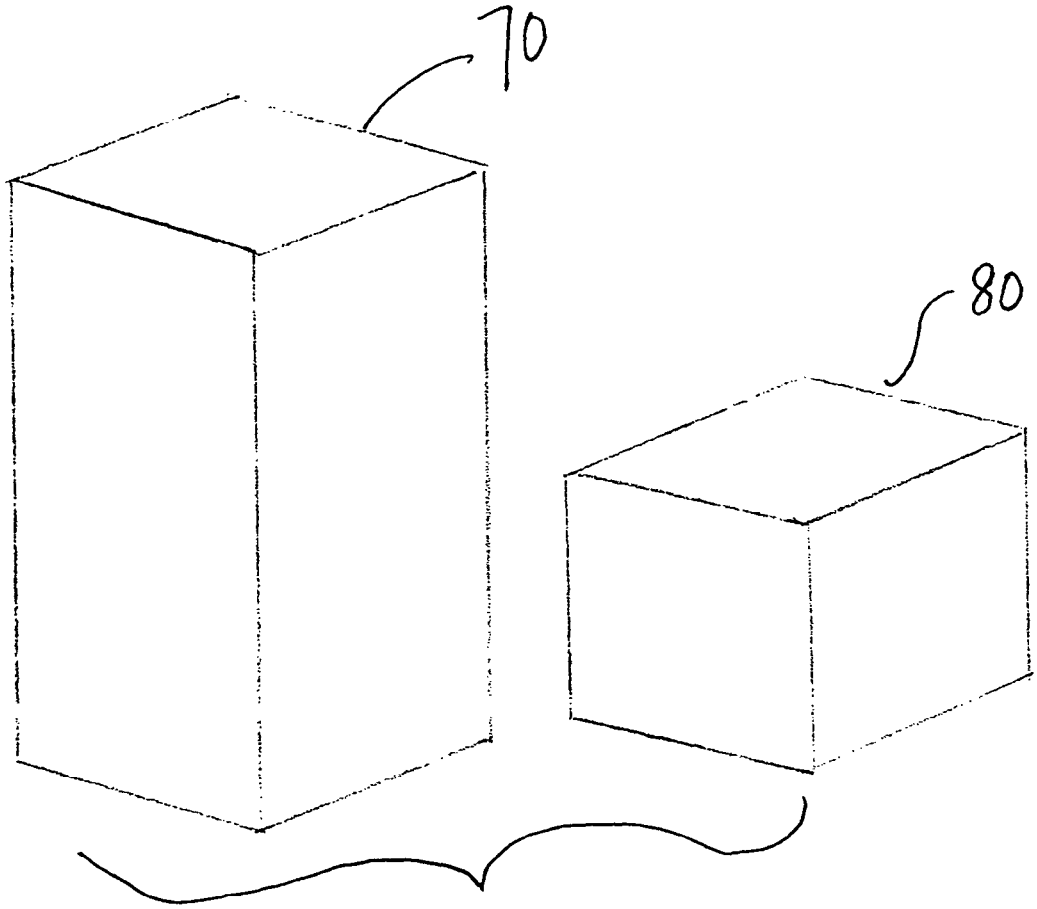
FIG. 8 are views of comparative rectangular packaging cartons suited for holding an assembled computer security cart and a disassembled computer security cart in accordance with the invention.

Turning to FIG. 8, comparative shipping cartons 70, 80 are shown, each being rectangular in configuration. In the assembled condition aside from the wheels 42, the mobile computer security cart 10 of FIG. 6 would fit within the confines of the shipping carton 70. In the disassembled condition, the mobile computer security cart 10 of FIG. 1 would fit within the confines of the shipping carton 80.

While shipping carton 80 is wider than shipping carton 70, the increase in volume due to this increase is width is considerably less than the volume displaced in the shipping carton 70 due to its increased height over that of shipping carton 80. Thus, from the standpoint of shipping costs, the mobile computer security cart 10 in disassembled condition of FIG. 1 is cheaper to ship that the mobile computer security cart 10 in assembled condition of FIG. 6 or that of its equivalent if the computer security part 30 were all one contiguous, unitary structure (i.e., the platform 32 and the upright 33 were either secured together or had unbroken and continuous sides to form a unitary structure). The hardware 40 may be packaged on its own and fit within the cabinet part 20 and thus within confines of the carton 80 as well.

Figure 9:
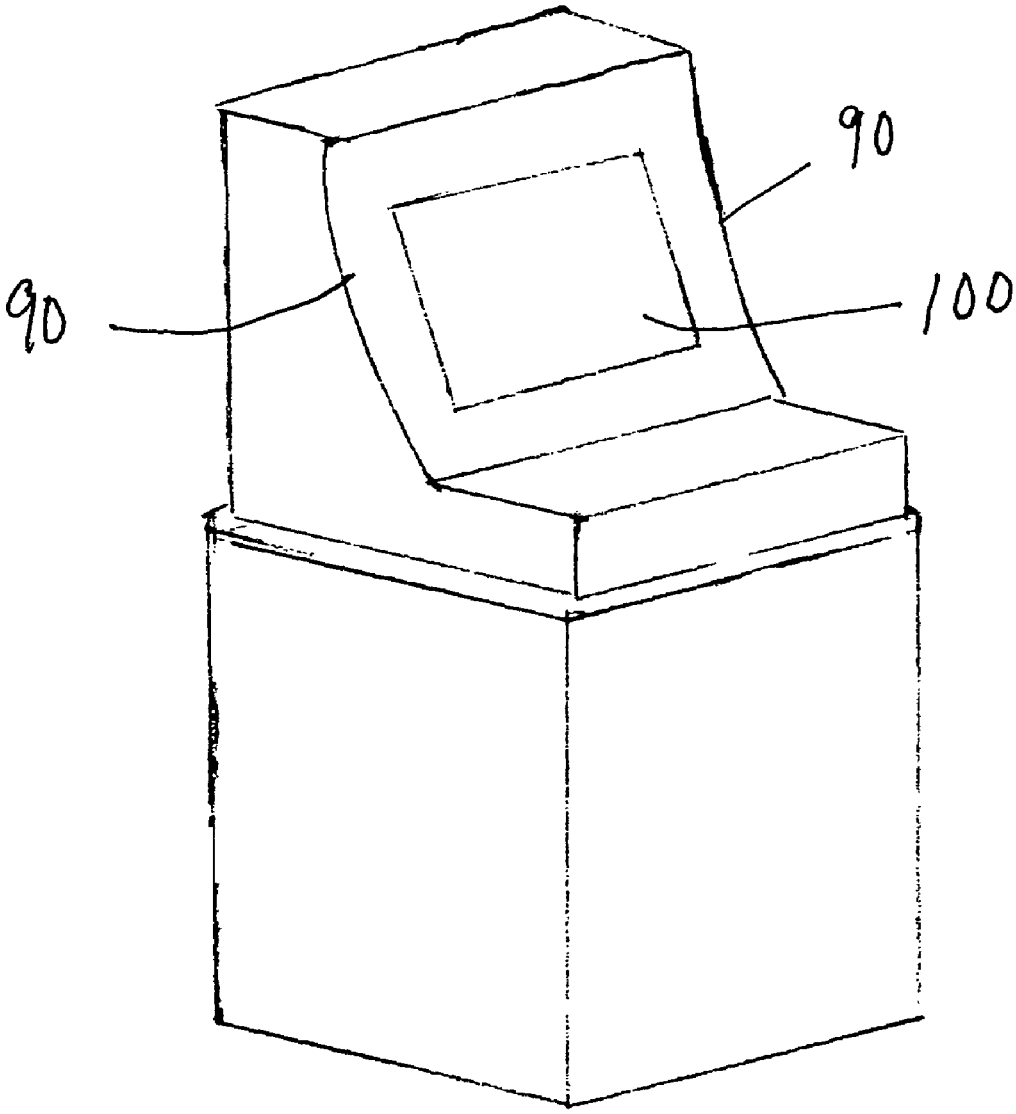
FIG. 9 is an alternative embodiment of the computer security cabinet wherein oppositely disposed angular sides define an area for a display.

FIG. 9 shows an alternative embodiment of a computer security cart wherein the upright has oppositely disposed slanted side walls 90 that at least partially define a display storage area 100.

While the foregoing description and drawings represent the preferred embodiments of the present invention, it will be understood that various changes and modifications may be made without departing from the spirit and scope of the present invention.

What is claimed is:

1. A mobile computer security cart, comprising:

a cabinet configured to accommodate at least one shelf and having a top, bottom, front, rear and sides, a platform coupled to the cabinet and arranged above the cabinet when coupled thereto, the platform having a top surface including an uncovered substantially planar surface, an upright coupled to the platform and arranged above the platform when coupled thereto, the upright including an interior space in which at least one display can be accommodated, a first fastening arrangement that fastens the upright to the platform, and a second fastening arrangement different than the first fastening arrangement and that fastens the cabinet to both the platform and the upright, the second fastening arrangement being an internal fastening arrangement that extends through aligned openings in the cabinet, the platform and the upright that are inward of exterior, planar outer surfaces of the cabinet, the platform and the upright, and wherein the cabinet, platform and upright are separate components and the upright has a height that is substantially the same as a height of the cabinet such that when the security cart is in a disassembled and packagable configuration, the upright is positionable adjacent to each of the front, rear and sides of the cabinet while the platform is positioned adjacent to one of the top and bottom of the cabinet.

2. The cart of claim 1, wherein the platform is configured to accommodate a drawer slidable between retracted and extended positions relative to the platform.

3. The cart of claim 2, wherein the drawer is configured to accommodate a lock.

4. The cart of claim 2, wherein the platform defines an opening through which the drawer is slidable, the uncovered substantially planar surface of the platform inclining in a direction toward the opening.

5. The cart of claim 1, wherein the substantially planar surface is inclined.

6. The cart of claim 1, wherein the top surface of the platform includes a level portion, the upright being coupled to the level portion of the top surface of the platform, the first fastening arrangement comprising retainers arranged on the level portion of the top surface of the platform which are adapted to engage with corresponding slots on an underside of the upright, the second fastening arrangement comprising fasteners that extend through apertures in an upper surface of the cabinet, through the platform and into apertures in a lower surface of the upright.

7. The cart of claim 1, wherein the upright is disposed above only a portion of the top surface.

8. The cart of claim 1, wherein the upright has a rear and sides that at least partially define a first storage area and at least one door that substantially encloses the first storage area, the first storage area being defined in the interior space in which the at least one display is accommodated.

9. The cart of claim 8, wherein the at least one door has at least one window.

10. The cart of claim 8, wherein the at least one door is configured to accommodate a lock.

11. The cart of claim 8, wherein the upright has at least one opening defining a second storage area below the first storage area and between the first storage area and the platform, the second storage area being defined in the interior space in which the at least one display is accommodated.

12. The cart of claim 1, wherein the cabinet has a shelf, rear and sides that at least partially defines a cabinet storage area and at least one door that substantially encloses the cabinet storage area.

13. The cart of claim 12, wherein the at least one door is configured to accommodate a lock.

14. The cart of claim 1, wherein the cabinet has a shelf that defines a bottom of the cart, further comprising wheels secured to an underside of the shelf.

15. The cart of claim 1 wherein the cabinet, platform and upright have an assembled configuration wherein the cabinet has a top and the platform rests on the top of the cabinet and the upright rests on at least one of the platform and the top of the cabinet.

16. The cart of claim 1 wherein the first fastening arrangement comprises first and second fasteners arranged at a front of the upright on left and right sides thereof and the second fastening arrangement comprises first and second fasteners arranged at a rear of the upright, the platform and the cabinet on left and right sides thereof.

17. The cart of claim 1, wherein the upright has a rear and oppositely disposed angular sides that at least partially define a display storage area, the display storage area being defined in the interior space in which the at least one display is accommodated.

18. A mobile computer security cart, comprising:

a cabinet having a top, bottom, front, rear and sides, the cabinet being configured to accommodate at least one shelf, a platform having an uncovered substantially planar surface, an upright including an interior space suited to accommodate a display, a first fastening arrangement that fastens the upright to the platform, and a second fastening arrangement different than the first fastening arrangement and that fastens the cabinet to both the platform and the upright, the second fastening arrangement being an internal fastening arrangement that extends through aligned openings in the cabinet, the platform and the upright that are inward of exterior, planar outer surfaces of the cabinet, the platform and the upright, wherein the cabinet, platform and upright are separate components, wherein the cabinet, the platform and the upright have an assembled configuration wherein the platform rests on a top of the cabinet and the upright is coupled to and arranged above the platform and each of the cabinet, the platform and the upright are secured in position, wherein the upright has a height that is substantially the same as a height of the cabinet such that when the security cart is in a disassembled configuration, the upright is positionable adjacent to each of the front, rear and sides of the cabinet while the platform is positioned adjacent to at least one of the top and bottom of the cabinet.

19. The cart of claim 18, wherein the platform is configured to accommodate a drawer slidable between retracted and extended positions relative to the platform.

20. The cart of claim 19, wherein the drawer is configured to accommodate a lock.

21. The cart of claim 19, wherein the platform defines an opening through which the drawer is slidable, the uncovered substantially planar surface of the platform inclining in a direction toward the opening.

22. The cart of claim 18, wherein the substantially planar surface of the platform is inclined.

23. The cart of claim 18, wherein the upright is coupled to a top surface of the platform.

24. The cart of claim 18, wherein the upright is disposed above at least a portion of a top surface of the platform.

25. The cart of claim 18, wherein the upright has a rear and sides that at least partially define a first storage area and at least one door that substantially encloses the first storage area, the first storage area being defined in the interior space in which the display is accommodated.

26. The cart of claim 25, wherein the at least one door has at least one window.

27. The cart of claim 25, wherein the at least one door is configured to accommodate a lock.

28. The cart of claim 25, wherein the upright has at least one opening defining a second storage area below the first storage area and between the first storage area and the platform, the second storage area being defined in the interior space in which the display is accommodated.

29. The cart of claim 18, wherein the cabinet has a shelf, rear and sides that at least partially defines a cabinet storage area and at least one door that substantially encloses the cabinet storage area.

30. The cart of claim 29, wherein the at least one door is configured to accommodate a lock.

31. The cart of claim 18, wherein the cabinet has a shelf that defines the bottom of the cabinet, further comprising wheels secured to an underside of the shelf.

32. The cart of claim 18, further comprising packaging that has a rectangular configuration and encloses all of the cabinet, the platform and the upright in their disassembled configuration.

33. The cart of claim 18 wherein the first fastening arrangement comprises first and second fasteners arranged at a front of the upright on left and right sides thereof and the second fastening arrangement comprises first and second fasteners arranged at a rear of the upright, the platform and the cabinet on left and right sides thereof.

* * * * *